United States Patent [19]

Marovskis

[11] Patent Number: 4,998,637

[45] Date of Patent: Mar. 12, 1991

[54] SHIPPING CONTAINER FOR PACKING UNITS

[75] Inventor: Harijs B. Marovskis, Seymour, Conn.

[73] Assignee: Tetra Pak Holdings & Finance S.A., Pully, Switzerland

[21] Appl. No.: 282,561

[22] Filed: Dec. 12, 1988

[51] Int. Cl.[5] ..... B65D 19/00

[52] U.S. Cl. ..... 220/6; 220/4.33; 220/1.5

[58] Field of Search ..... 220/6, 4 F, 1.5

[56] References Cited

U.S. PATENT DOCUMENTS

| | | | |
|---|---|---|---|
| 2,903,126 | 9/1959 | Heath | 220/1.5 X |
| 3,246,828 | 4/1966 | Branscom et al. | 220/4 F |
| 3,406,821 | 10/1968 | Weissberg | 220/345 X |
| 3,497,127 | 2/1970 | Box | 220/6 X |
| 3,589,548 | 6/1971 | Weiss | 220/4 F |
| 4,010,865 | 3/1977 | Wilgus | 220/6 |
| 4,643,314 | 2/1987 | Kidd | 220/6 X |
| 4,781,300 | 11/1988 | Long | 220/6 X |

*Primary Examiner*—Steven M. Pollard

*Attorney, Agent, or Firm*—Burns, Doane, Swecker & Mathis

[57] ABSTRACT

The present invention is directed to a packing or shipping container which is adapted to receive a plurality of individual units of material to be shipped within the packing or shipping container. The container is adapted to be stackable, one upon the other, with a plurality of other containers when in its filled or packed condition and when in a unfolded or empty condition. The assembly permits ease of construction of the packing container for receiving the individual packing units and the ease of shipment of filled containers and return of disassembled or unfolded containers.

7 Claims, 4 Drawing Sheets

Fig. 1
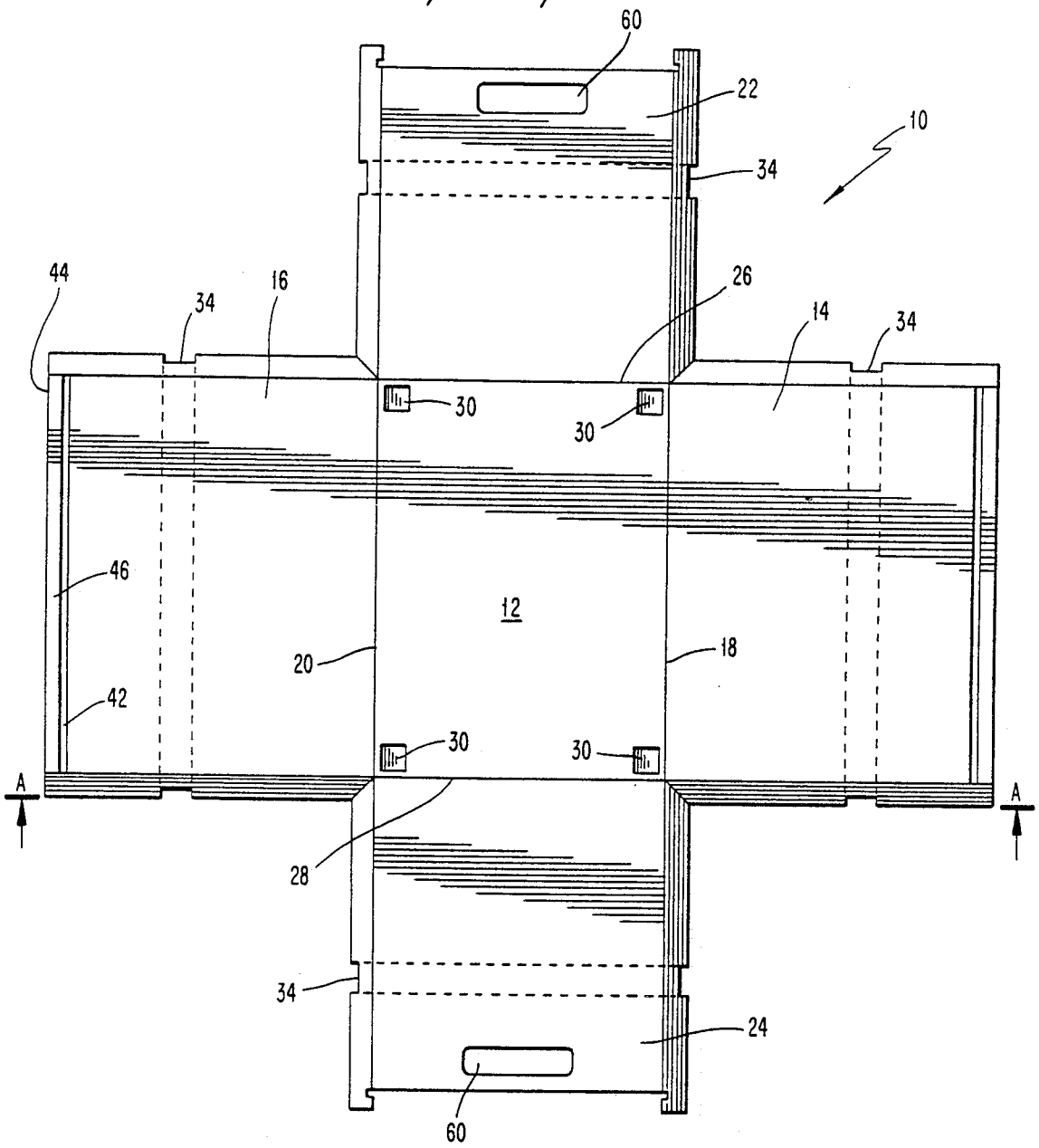
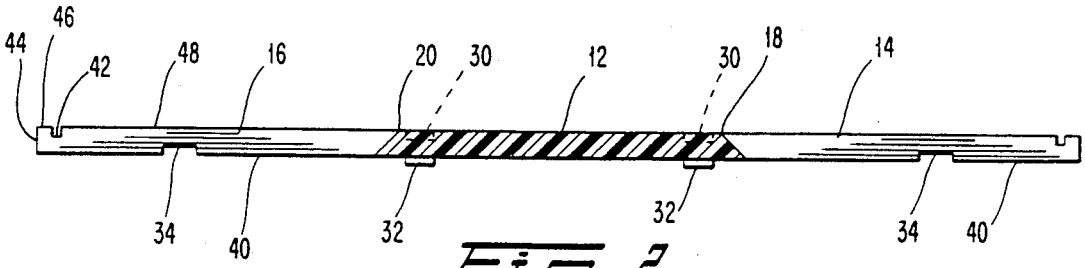
Fig. 2

Fig. 3
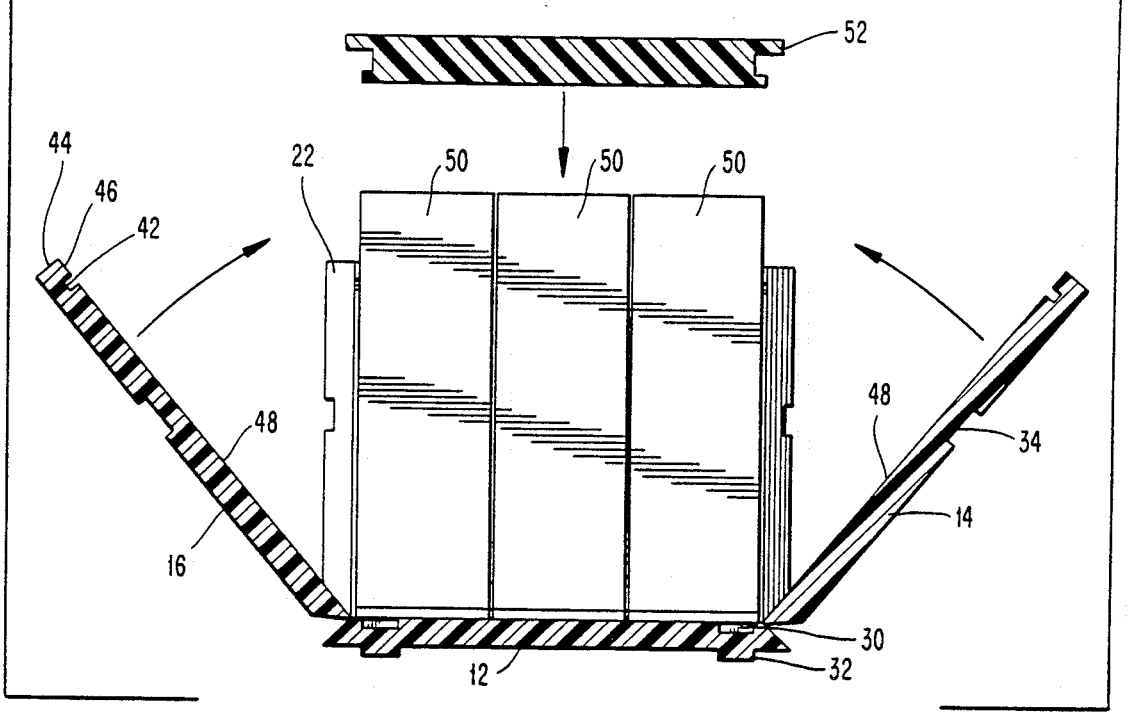
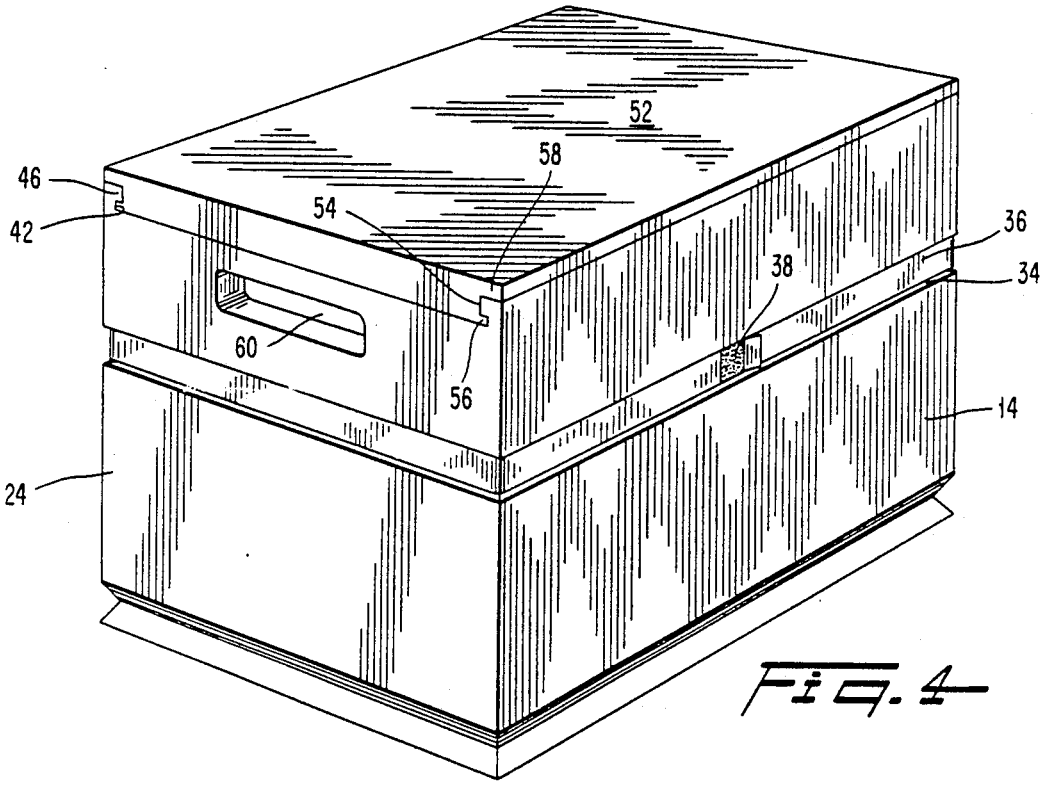
Fig. 4

Fig. 5
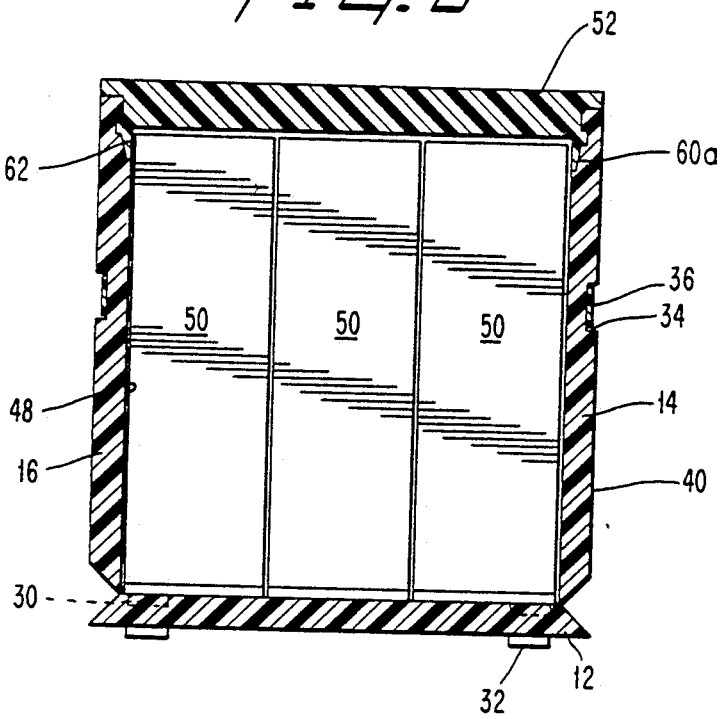
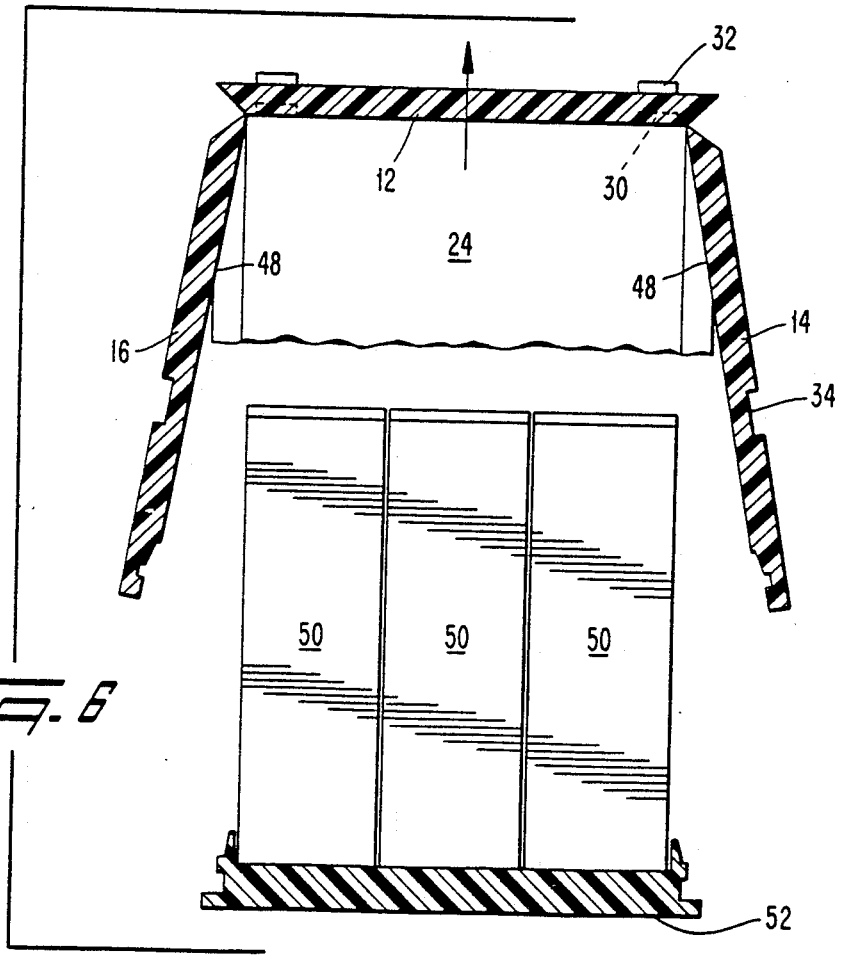
Fig. 6

SHIPPING CONTAINER FOR PACKING UNITS

BACKGROUND OF THE INVENTION

1. Field of the Invention

The present invention relates to shipping containers in which a plurality of individual packing units may be easily transported and more particularly to containers that may be folded when not in use.

2. Description of the Prior Art

Shipping containers have been utilized in which individually packed units are transported within the shipping container. An example of such a container is U.S. Pat. No. 3,841,477. Therein, a outer container for packing units is disclosed in which the outer container comprises a substantially rectangular sheet of relatively rigid material. The sheet is provided with two parallel folding lines which are placed at a distance from one another and are parallel with opposite parallel edges of the sheet. The provision of two parallel folding lines effectively divides the sheet into three sections, i.e., a base section and two lateral sections. The lateral sections are set up by folding the sections about the parallel folding lines so as to form a U-shaped container. Individual packing units are then tightly packed onto the base area and held between the lateral sections of the container. Notches are provided in edge portions of the lateral sections so as to receive one or more cords or bands which are arranged around the lateral sections so as to maintain the lateral sections in the folded position and to tightly secure the individual packing units within the outer container.

U.S. Pat. No. 3,841,477 fails to realize an arrangement by which a plurality of packing units can be conveniently and neatly packaged for shipment and removal from the shipping container and which permits the shipping container itself to be neatly stackable along with a plurality of other containers when filled with a plurality of packing units. Additionally, the patent fails to provide for a shipping container which is provided with the physical configuration which assists in the stacking or nesting of the individual containers in both the folded and unfolded configurations.

An additional example of a container is disclosed in U.S. Pat. No. 3,561,595. Therein, a tape cartridge holder is provided which has a floor member with opposing and hingedly connected flap-type side walls. The side walls are connected, through the hinge, to the floor portion and extend across the floor and upwardly to terminal edge portions. Cut-outs are provided along an upper section of each of the sidewalls so as to receive a resilient arrangement which is provided to connect the flap walls and to hold them together in an assembled and upright manner. The container also includes opposite partial end walls of a truncated, triangular shape. The opposite edges of the end walls further define the container area when in a raised position. When assembled, the container provides side walls which slope inwardly toward the area defined by the raised side and end wall panels. Accordingly, a base area is provided which is larger than the open area defined and bounded by the upraised side and end portions. This particular arrangement permits the elastic member, holding the side walls together, to be expanded so that the individual units packed therein can move relative to one another so as to more clearly expose each of the units for view when packed in the container.

U.S. Pat. No. 3,561,595 therefore fails to contemplate the advantages of the present invention by lack of disclosure relating to the manner in which the cartridge holders could be configured so as to be nested or stacked with other cartridge holders when in an empty configuration. The patent is silent with regard to any advantages which could be obtained from its particular configuration with regard to the storage of a plurality of the holders when filled with various numbers of tape cartridges.

Another example of such a holder or container is U.S. Pat. No. 466,384. Therein an account book holder is provided in which a bottom section and two side walls which can be folded up from the bottom and secured in place by a cord member. A single end wall section is provided which is connected to each of the side wall sections. The end wall section is hinged to the bottom section so as to close one end of the container. However, a fastening arrangement in the form of a cord is connected to both side wall sections so that the end wall section may be displaced from its fully upright position. In the alternative, the cord member would permit the end wall section to be retained in a substantially perpendicular position with respect to the bottom wall section while permitting the side wall sections to be moved outwardly, i.e., to a position defining an oblique angle with respect to the bottom wall section. This arrangement permits the side walls to be displaced from their substantially perpendicular position so as to allow easy access to the contents of the holder and permit the contents of the holder to move relative to one another.

SUMMARY OF THE INVENTION

Accordingly, it is an object of the present invention to provide a shipping container for a plurality of individual packing units which overcomes the drawbacks of the above-discussed containers so as to permit the plurality of packing units to be conveniently and neatly packaged for shipment and removal from the shipping container and which permits the shipping container to be neatly stackable, along with a plurality of other containers, in either its folded or unfolded configuration.

The foregoing object is achieved by providing a foldable shipping container for individual packing units which has a plurality of side walls integrally connected to a bottom section. The plurality of side walls are foldable, in one direction, with respect to the bottom section so as to be movable from a common plane with the bottom section to a position which is substantially normal to the bottom section. The bottom section is provided with a plurality of recessed regions on a first side or interior section of the container and a plurality of protrusions which extend from a second side of the bottom section. The protrusions and recesses are aligned with one another to assist in the stacking or nesting of the individual containers, in both their unfolded and folded configurations.

The wall sections of the foldable container are connected to the bottom section by hinged folding line which permits movement of the walls in a single, predetermined direction. A channel is provided along the exterior of each of the walls of the container which receives a band or strap for securing and holding the sections in their position which is substantially perpendicular to the bottom section, i.e., the container being in a folded state and provided with the plurality of individual packing units.

The wall portions of the unit are provided with a groove which extends along the length of the side walls and which is adapted to receive a top section slidable within the groove so as to define a closed container of predetermined volume. The top section can be provided with an arrangement to either slide directly into the grooves of the walls or be provided with mating and corresponding groove sections so as to further facilitate insertion and withdrawal of the top section from the grooved walls.

BRIEF DESCRIPTION OF THE DRAWINGS

A preferred embodiment of the invention is illustrated in the accompanying drawings in which:

FIG. 1 is a top view of the shipping container in an unassembled configuration;

FIG. 2 is a cross-sectional view of the container taken along the line A—A of FIG. 1;

FIG. 3 is a cross-sectional view of the shipping container in a partially assembled state with individual packing units assembled therein;

FIG. 4 is a perspective view of an assembled shipping container;

FIG. 5 is a cross-sectional view of the assembled shipping container;

FIG. 6 is a cross-sectional view partially schematic of the shipping container in a partially disassembled condition;

DETAILED DESCRIPTION OF A PREFERRED EMBODIMENT

Figure 7:
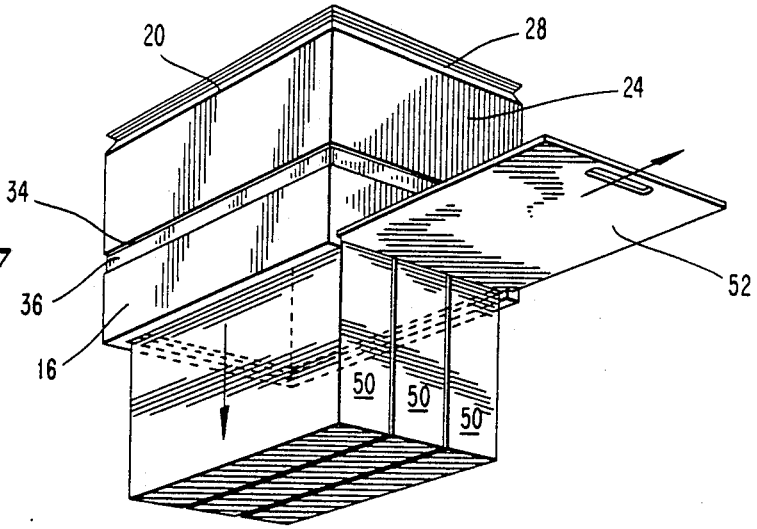
FIG. 7 is a perspective view of the shipping container illustrating removal of the packing units.

With reference to FIG. 1, the reference numeral 10 generally indicates the shipping container in an unfolded, unassembled state. A bottom section, on which individual packing units will be supported, is indicated at 12. Side walls 14 and 16 are connected to the bottom section along folding lines 18 and 20 which also define hinges. End walls 22 and 24 are connected to the bottom section 12 along folding lines 26 and 28 which define hinges. A plurality of recesses, four in number as shown in FIG. 1, are indicated at reference numeral 30. The recesses 30 are provided in the bottom section 12. The recesses 30 are spaced inwardly of the folding lines 18, 20, 26 and 28. Protrusions 32, shown in FIG. 2, extend from the bottom section 12 in a downwardly direction, as viewed in FIG. 2. Each of the protrusions 32 is aligned with the corresponding recess 30.

The foldable shipping container is also provided with a channel 34 in each of the side and end walls 14, 16, 22 and 24. The channel 34 receives a strap 36 (FIG. 4) when the side and end walls are in a raised position. The beveled edge of the side and end walls position the walls perpendicular to each other and perpendicular to the bottom 12" to serve as a shipping container. The strap 36 is secured by a heat seal arrangement 38 along an exterior side 40 of the side walls and end walls. Purposes of this description, only one top edge portion will be A top edge portion of the side walls 14 and 16 are provided with a groove 42. Between the groove 42 and the top edge 44 of the wall, a tongue portion 46 is defined. The groove 42 and tongue 46 of each of the side walls is provided along an interior portion 48 of each of the side and end walls, respectively. The interior 48 refers to the location of the side and end walls when the side and end walls sections 14, 16, 22 and 24 are in a raised and secured position so as to form the assembled shipping container.

FIG. 3 shows the shipping container 10 in a partially assembled state in which individual packing units 50 have been packed in the shipping container 10 so as to be positioned and supported by the bottom section 12. End wall section 22 is shown in its raised position which is substantially perpendicular to the bottom section 12. Side walls 14 and 16 are shown in a partially raised position from that depicted in FIG. 1. A top 52 is shown in FIG. 3 in position to be received in the grooves 42 provided in the side walls. When each of the side walls 14, 16, 22 and end walls 24 are in the raised position, i.e., substantially perpendicular to the bottom wall 12, the top 52 is inserted into the groove and tongue arrangement 42, 46 so as to secure the plurality of individual packing units 50 in the foldable shipping container.

With reference to FIG. 4, an assembled shipping container is shown in which the side walls are held in the assembled position by a strap 36 which is received in the channel 34. The top 52 is shown in greater detail in FIG. 4. The top 52 is also provided with a groove 54 and lip portions 56 and 58. The lip portion 58 extends over the top edge 44 of the side walls and the lip 56 and is substantially flush with edge 44 of the end wall 24. The groove 54 is defined therebetween and receives the tongue section 46 of the side walls. Accordingly, an interlocked top 52 is provided so as to enclose the plurality of individual packing units 50 contained within the assembled shipping container. In order to facilitate handling of the shipping container, handle openings 60 are provided in the end walls 22, 24.

FIG. 5 shows a side cross-sectional view, of the assembled and filled shipping container. Therein, it can be seen that for ease of assembly of the top 52 to the shipping container, an optional gradually tapering slot **60*a* is provided along the interior side wall portion 48. The gradually tapering slot 60*a* is mated with a corresponding tapering extension 62 of the lip portion 56**.

With reference to FIGS. 6 and 7, the shipping container may be disassembled so as to remove the easily individual packing units 50 which were packed inside during shipment. The individual packing units 50 are originally packed in the assembled shipping container in an upside down orientation. Accordingly, when the shipping container is to be emptied of its contents, it is inverted in the manner shown in FIGS. 6 and 7. If the top wall 52 is desired to be retained as a base support element for the individual packing units, it may be placed on any type of support platform and the securing strap 36 is removed by breaking the heat seal 38. Upon removal of the securing strap 36, the wall sections, shown in FIG. 6 as walls 14 and 16, may be partially folded away from their normal position with respect to the bottom section 12 and the integral foldable container as shown in FIGS. 1 and 2 may be lifted off the plurality of individual packing units 50 as supported on the top 52. An alternative arrangement for unloading is shown in FIG. 7. The foldable container is again inverted, but the securing strap 36 is not removed. Instead, the top 52 is slid through the tongue and groove arrangement described in conjunction with FIGS. 4 and 5 so as to open the assembled packing container and permit the individual packing units 50 to drop out of the shipping container in an upright position.

Figure 8:
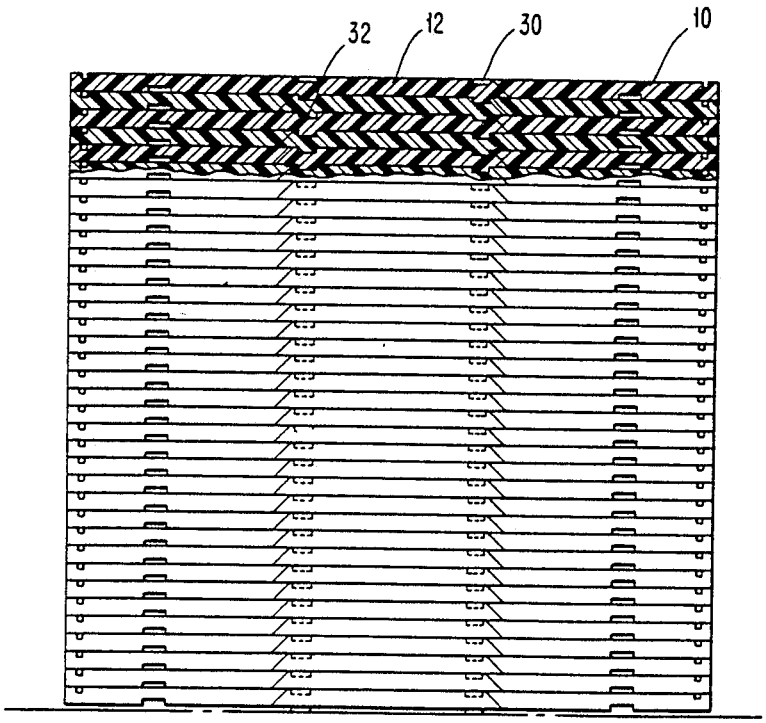
FIG. 8 is a side elevational view of a plurality of unfolded stacked crates as shown in FIG. 2.
Figure 9:
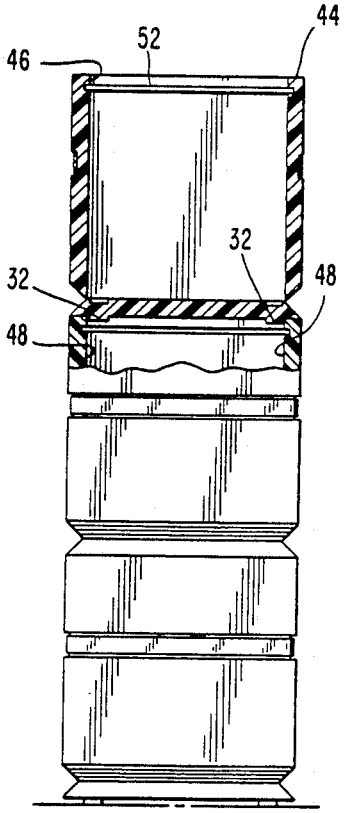
FIG. 9 is a side elevational view of a plurality of assembled and stacked crates.

With reference to FIGS. 8 and 9, the foldable shipping containers of the present invention can be stacked and nested upon one another without relative movement therebetween when being shipped in a filled or packed condition or when being returned in an unfolded condition. More specifically, FIG. 8 shows the unfolded shipping containers 10 nested, one on the other, with the protrusions 32 extending into the recesses 30 provided in the bottom section of the shipping container. Such an interlocked arrangement will permit a plurality of unfolded shipping containers to be stacked on a pallet or other convenient moveable storage arrangement so as to be shipped in a neatly packaged arrangement. Further, the protrusions 32 also serve a useful purpose when the containers are used in the manner illustrated in FIG. 7. After the top 52 is removed, the containers may be stacked as shown in FIG. 9. The protrusions 32, being spaced inwardly from the interior surface of the side walls 14, 16, so that they are snugly received with the open top to prevent lateral displacement of the stacked containers. Thus, it can be seen that a returnable and foldable container is provided which may be continually reused for the transport of individual packing units. The returnable container may be manufactured of injected molded plastic (polypropylene, polyethylene or similar material). The shipping container 10 is of one piece construction in which the side and end walls are connected to a bottom wall section by a hinge arrangement. The hinge arrangement is provided so as to permit the side and end walls to bend only in an upward direction relative to the bottom section 12.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the invention as set forth in the appended claims.

I claim:

1. A foldable shipping container for packing units comprising:

(a) a bottom section;

(b) first and second side walls integrally connected to said bottom section along first and second folding lines, respectively;

(c) first and second end walls integrally connected to said bottom section along third and fourth folding lines, respectively, said first and second side walls and said first and second end walls each having an interior side and an exterior side, the exterior side of each wall having a channel extending substantially parallel to said folding lines and strap means in said channel for securing each of said side walls and end walls in a position substantially perpendicular to said bottom section, said first and second side walls having a groove in said interior side extending substantially the length of said side walls;

(d) a plurality of recesses provided in a first side of said bottom section;

(e) a plurality of protrusions extending from a second side of said bottom section and said protrusions being aligned with said recesses, wherein said first and second side walls and said first and second end walls may be folded together along said first, second, third and fourth folding lines to define a container adapted to receive a plurality of individual packages; and (f) a top section provided in said groove so as to define a closed container of predetermined volume and including a tongue portion received in said groove, a lip portion extending over an edge of said side walls opposite said folding line and a gap defined between said tongue portion and said lip portion to receive an extension of said side walls.

2. A foldable shipping container for packing units according to claim 1, wherein said first and second side walls and said first and second end walls are connected to said bottom section by a hinge configuration along the folding line which prevents movement of said side and end walls in a predetermined direction.

3. A foldable shipping container for packing units according to claim 1, wherein said securing means encircles said side walls and said end walls and has first and second ends connected by a heat seal.

4. A foldable shipping container for packing units according to claim 1, wherein said first and second end walls each have a groove in said interior side which extend for substantially the length of said end walls.

5. A foldable shipping container for packing units according to claim 1, wherein cut-out areas are provided in at least one of said side walls and end walls.

6. A foldable shipping container for packing units according to claim 1, wherein said recesses and said protrusions are substantially aligned so as to permit a first foldable container to be stacked with at least a second foldable container also provided with said substantially aligned recesses and protrusions.

7. A foldable shipping container for packing units according to claim 1, wherein said protrusions are positioned axially inwardly of said folding lines so as to permit said protrusions to be positioned axially inwardly of each of said side walls and end walls when said side walls and end walls are in said position substantially normal to said bottom section.

* * * * *